US006518553B1

(12) United States Patent
Leykin et al.

(10) Patent No.: US 6,518,553 B1
(45) Date of Patent: Feb. 11, 2003

(54) FOOD COOKING DEVICE AND METHOD OF USE

(76) Inventors: Leonid Leykin, 38 Austringer Ct., Baltimore, MD (US) 21208; Aleksandr Kofman, 10 Buy Ct., Rockville, MD (US) 20850

( * ) Notice: Subject to any disclaimer, the term of this patent is extended or adjusted under 35 U.S.C. 154(b) by 0 days.

(21) Appl. No.: 09/953,745

(22) Filed: Sep. 17, 2001

(51) Int. Cl.[7] ..... H05B 6/80; H05B 6/78

(52) U.S. Cl. ..... 219/679; 219/680; 219/739; 219/695; 219/752; 219/762; 99/421 R; 99/451; 99/DIG. 14; 221/150 HC; 221/150 A

(58) Field of Search ..... 219/679, 685, 219/752, 753, 754, 756, 762, 680, 695, 748, 739, 389, 392; 99/DIG. 14, 451, 357, 421 R, 421 H; 221/150 HC, 150 A

(56) References Cited

U.S. PATENT DOCUMENTS 4,006,339 A * 2/1977 Maurer ..... 219/748
4,051,772 A * 10/1977 Johansson et al. ..... 221/150 A
4,437,206 A * 3/1984 Becker ..... 426/513
4,659,890 A * 4/1987 Viet ..... 219/753
4,783,582 A * 11/1988 Wada et al. ..... 99/357
4,999,468 A * 3/1991 Fadel ..... 219/685
5,048,719 A * 9/1991 Empl et al. ..... 221/150 HC
5,313,036 A * 5/1994 Chartrain et al. ..... 219/685
5,873,299 A * 2/1999 Leykin ..... 99/357

FOREIGN PATENT DOCUMENTS

JP 8-138140 * 5/1996

* cited by examiner

*Primary Examiner*—Philip H. Leung
(74) *Attorney, Agent, or Firm*—Piper Rudnick LLP; Steven B. Kelber

(57) ABSTRACT

A device for treating sausage in a hot dog dispensing machine has a substantially closed chamber for receiving a sausage, a unit associated with the chamber and operative for providing a microwave radiation into an interior of the chamber so as to provide cooking of an interior of the sausage, and a unit for generating an infrared radiation arranged outside of an area of the microwave radiation generated by the first unit so as to supply the infrared radiation into the interior of the chamber onto a sausage located in the chamber and therefore to treat a surface of the sausage to provide an exterior skin of the sausage.

26 Claims, 9 Drawing Sheets

FOOD COOKING DEVICE AND METHOD OF USE

BACKGROUND OF THE INVENTION

The present invention generally relates to vending machines, for example for dispensing such products as hot dogs, in particular to a device for thermal treatment of sausages for preparation of hot dogs.

Devices for thermal treatment of sausages are generally known. In the known devices of this type, the treatment is performed by application of heat for cooking a sausage. It is believed that these devices can be further improved.

SUMMARY OF THE INVENTION

Accordingly, it is an object of the present invention to provide a device for treating sausages in a hot dog dispensing machine, which avoids the disadvantages of the prior art and is a further improvement.

In keeping with these objects and with others which will become apparent hereinafter, one feature of present invention resides, briefly stated, in a device for treating sausages in a hot dog dispensing machine, which has a substantially closed chamber for receiving a sausage; means associated with said chamber and operative for providing a microwave radiation directed into an interior of said chamber so as to provide cooking of an interior of said sausage located in said chamber; and means for generating an infrared radiation outside of an area of the microwave radiation generated by said first means so as to supply the infrared radiation into the interior of said chamber onto the sausage located in said chamber and therefore to treat a surface of said sausage to provide an exterior cooked skin of the sausage.

When the device is designed in accordance with the present invention, it provides an optimal, highly efficient, and high quality way of treating sausage to provide a high quality hot dog with a very good taste.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
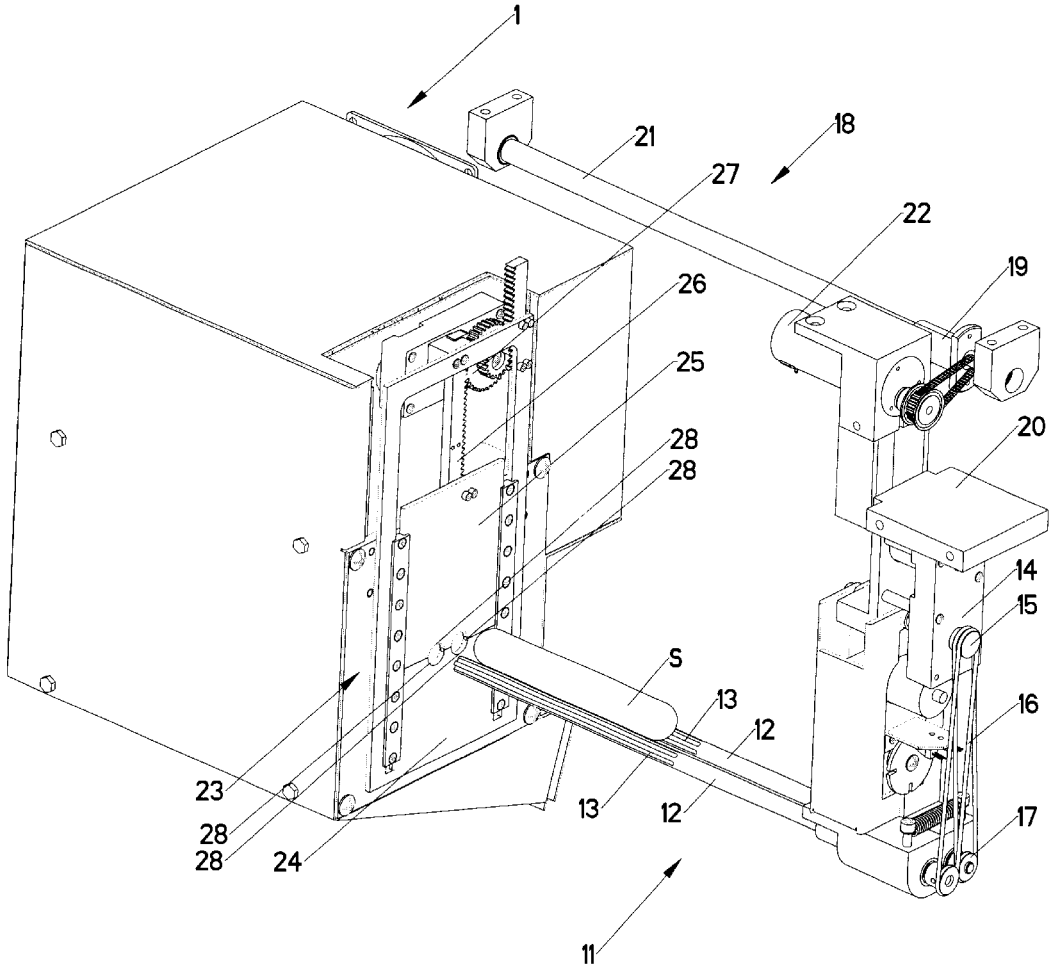
FIG. 1 is a perspective view showing a device for treating sausages in a hot dog dispensing machine.
Figure 2:
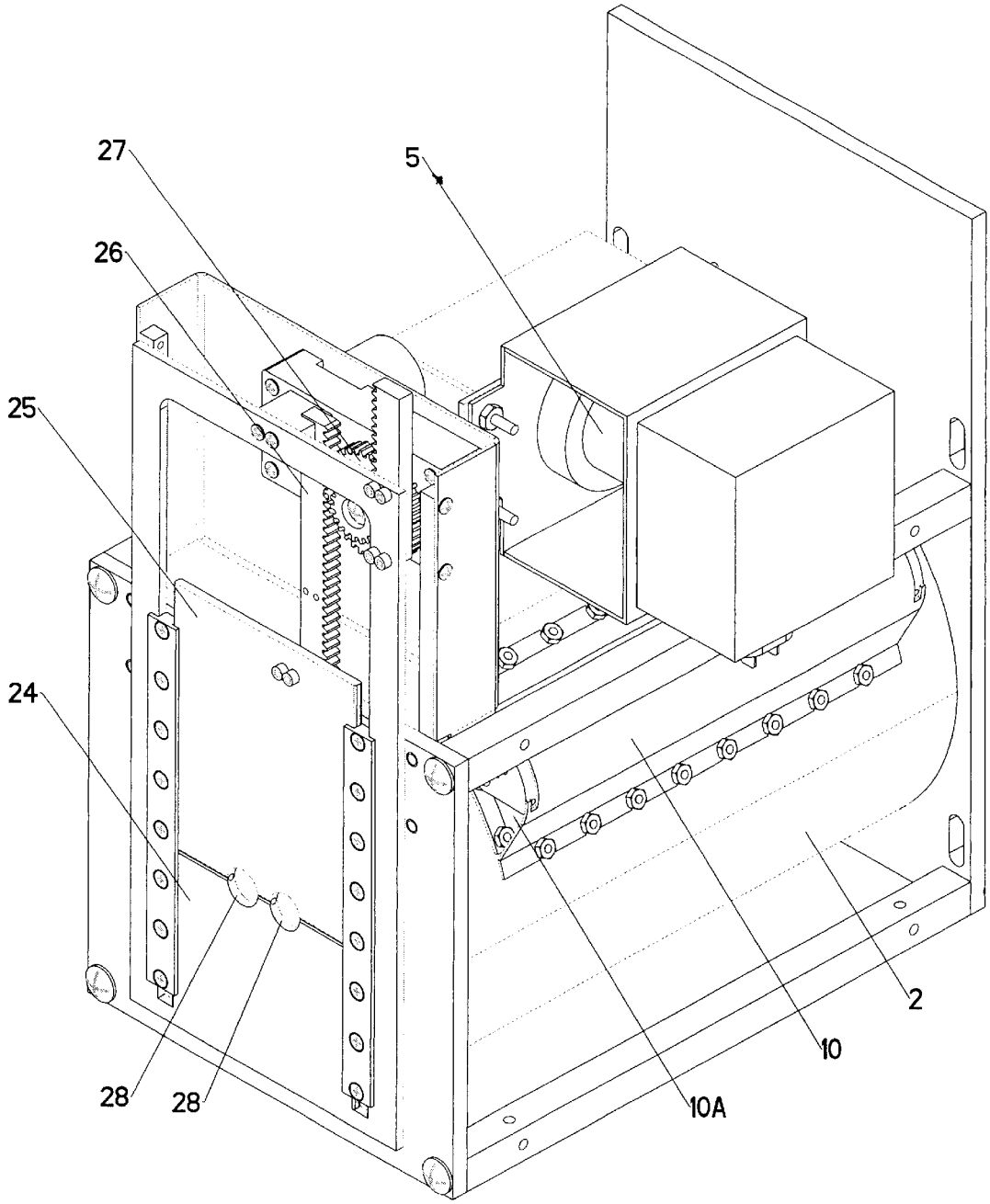
FIG. 2 is a perspective view a device for treating sausages in a hot dog dispensing machine from an opposite side.
Figure 3A:
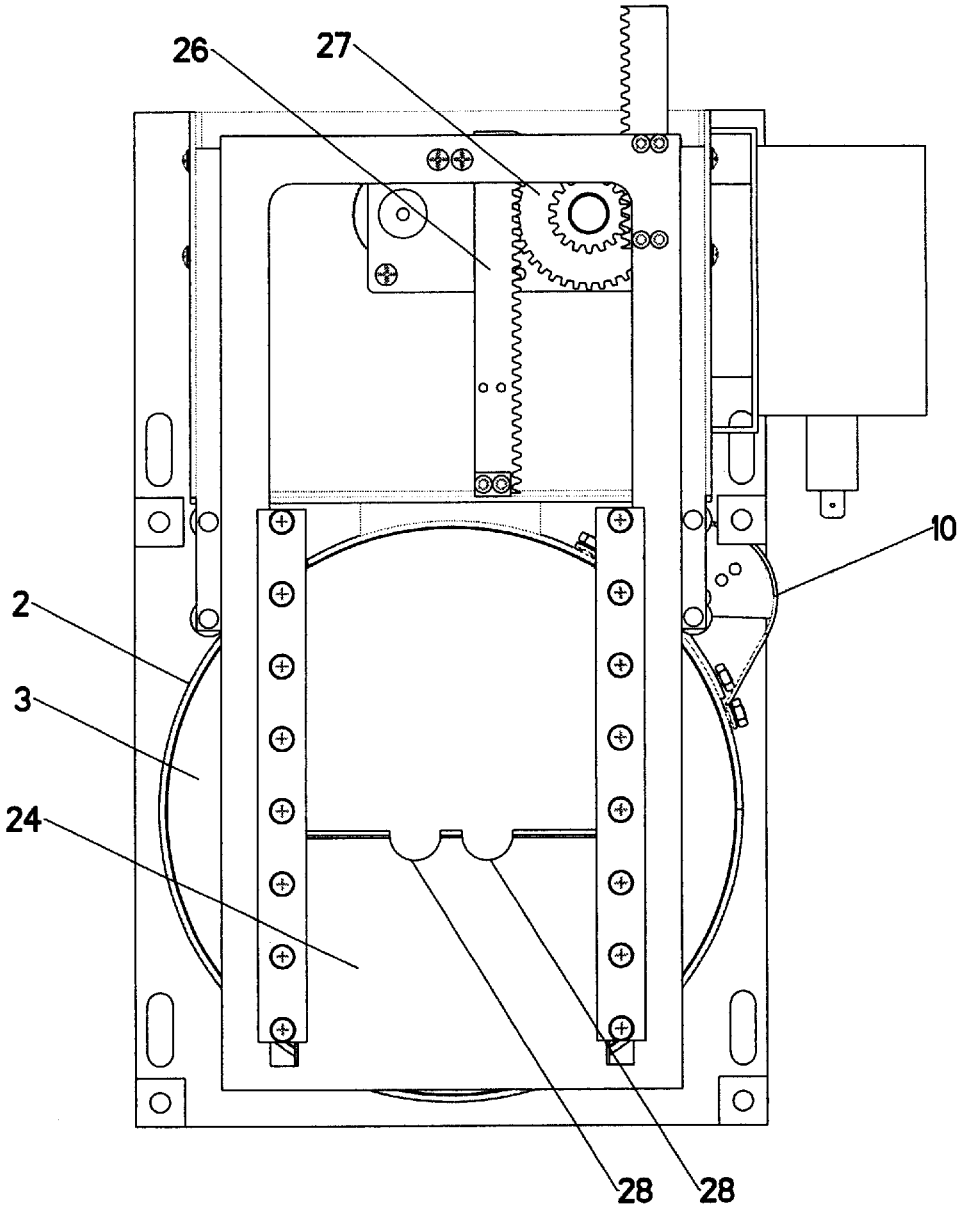
FIGS. 3A, 3B, 3C are a front view and two side views of the device in accordance with the present invention.
Figure 3B:
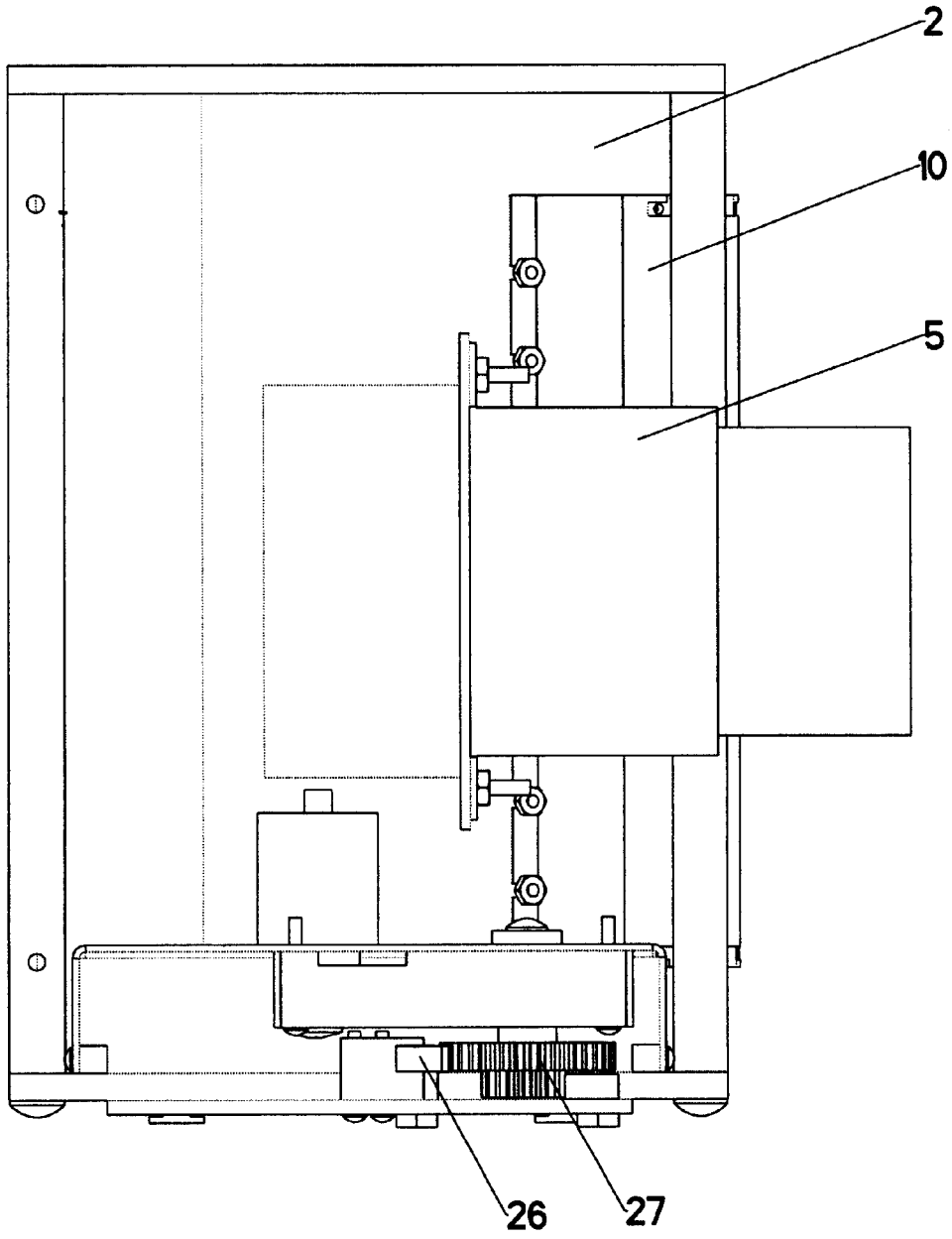
Figure 3C:
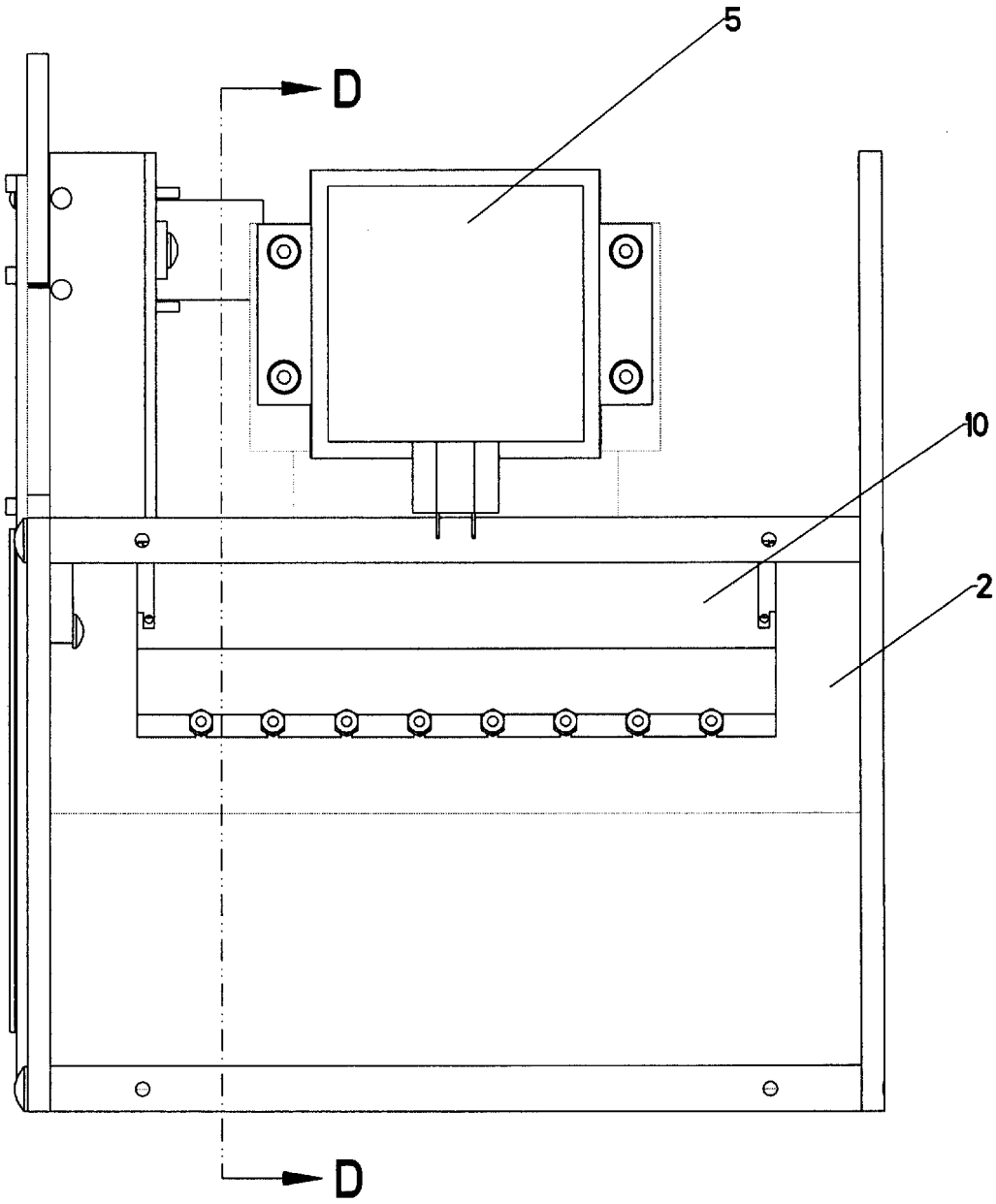
Figure 3D:
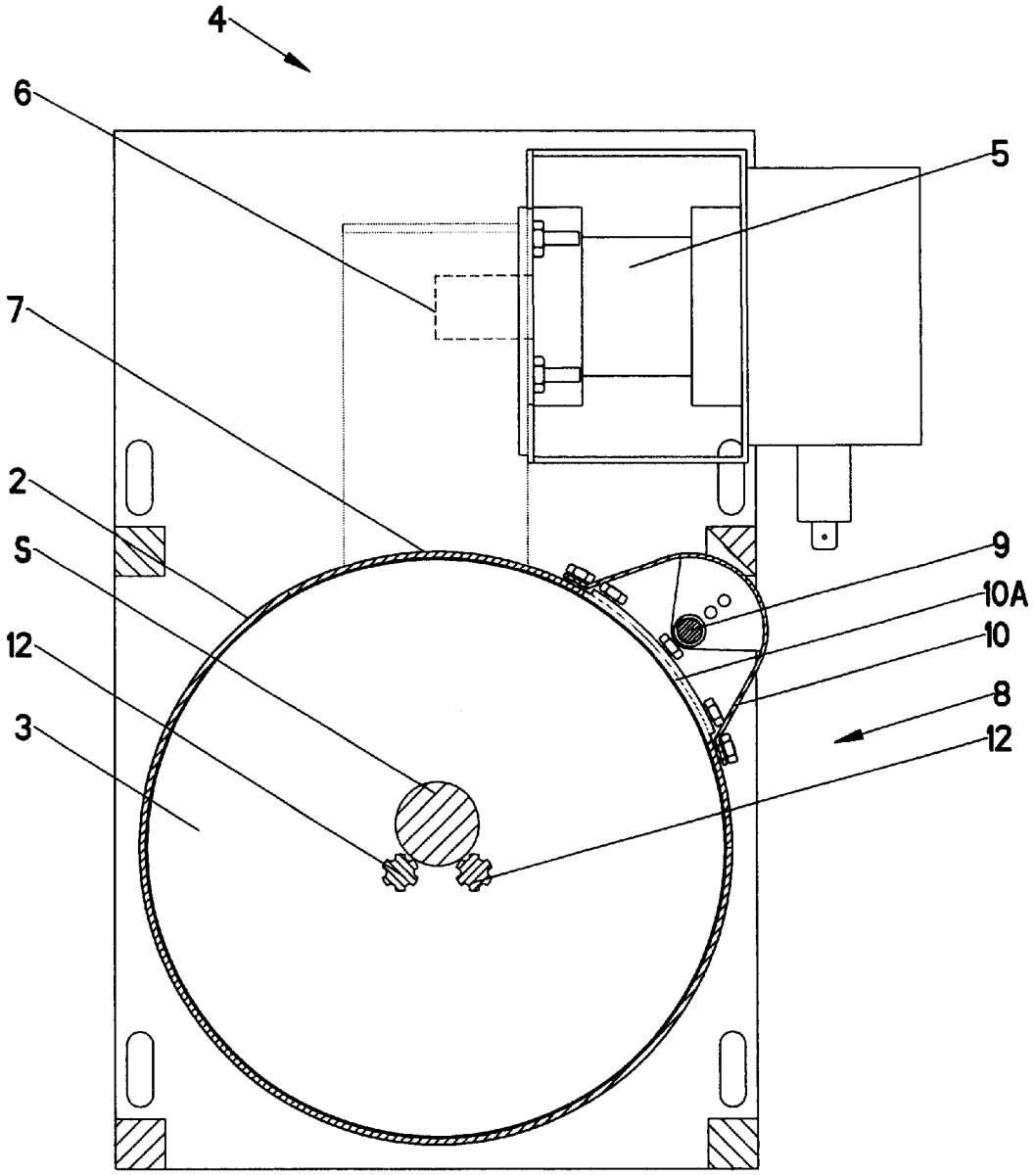
FIG. 3D is a section taken along the line D—D in FIG. 3C.
Figure 4A:
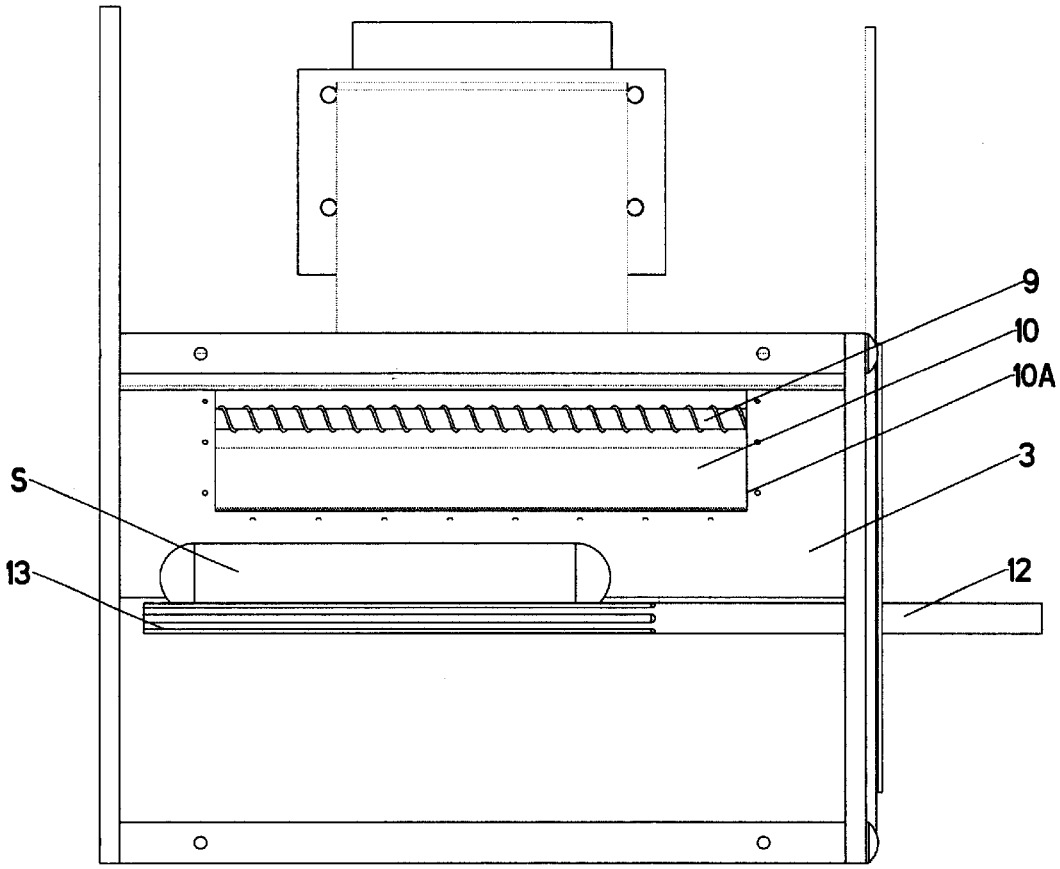
FIG. 4A and 4B are side views of the device with sausage inserting and withdrawing means in two different positions.
Figure 4B:
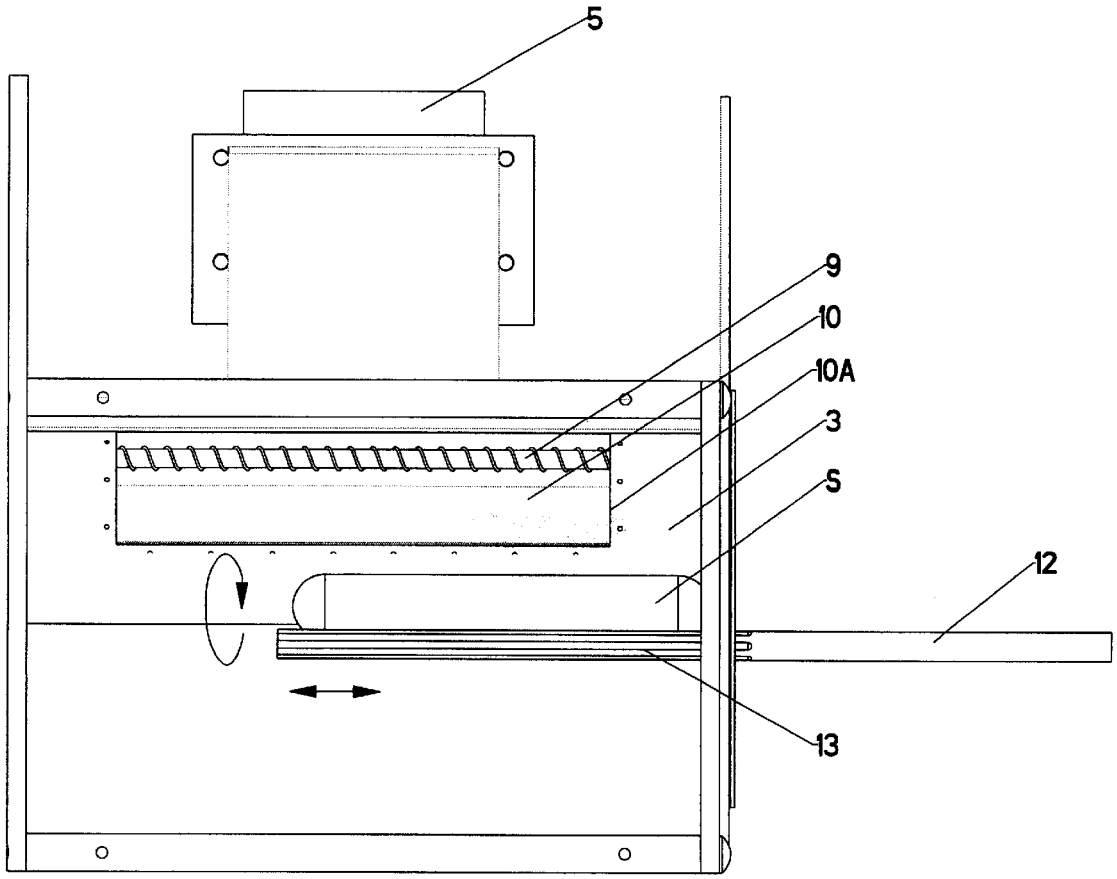

A device for treating sausage in hot dog dispensing machine in accordance with the present invention has a housing which is identified as a whole with reference numeral 1. Means forming a substantially cylindrical chamber is arranged inside the housing 1. The means can be formed as a cylindrical wall 2 which limits a cylindrical inner chamber 3.

The device is further provided with means for treating a sausage with a microwave radiation. Said means is identified as a whole with reference numeral 4. It includes a microwave magnetron 5 provided with a magnetron antenna 6. The cylindrical wall 2 has an opening 7 formed so that a microwave radiation beam emitted by the magnetron antenna 6 is supplied into an interior of the chamber 3. The device further has means for supplying an infrared radiation which is identified as a whole with reference numeral 8. Means for supplying the infrared radiation include for example an infrared lamp 9, a reflector 10, and a not shown power source for the infrared lamp 9. The infrared radiation emitted by the infrared lamp 9 is introduced into the interior of the chamber 3 through an opening 10A in the cylindrical wall Both sources of the radiation, in particular the microwave magnetron antenna 6 and the infrared lamp 9 are located outside of the cylindrical wall 2, and introduce corresponding radiation beams into the interior of the chamber 3. Also, the both sources of the radiation, namely the microwave magnetron antenna 6 and the infrared lamp 9 are offset relative to one another in a peripheral direction so that the radiation beams emitted by them do not interfere with one another.

Figure 5A:
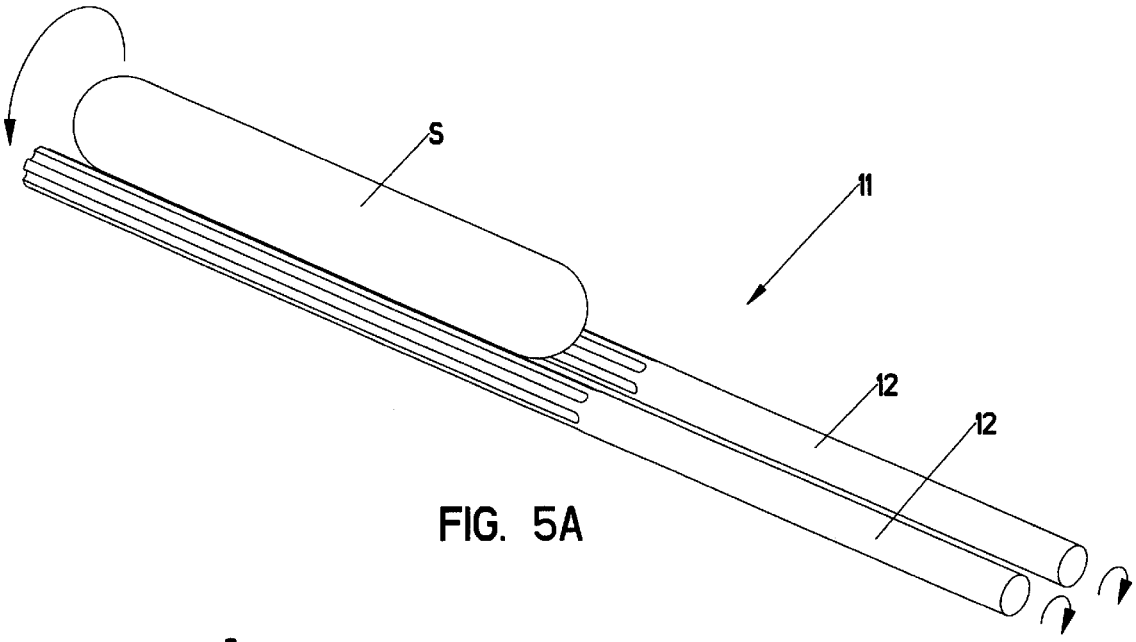
FIGS. 5A and 5B are side views and FIG. 5C is an end view of a device for introducing and withdrawing a sausage.
Figure 5B:
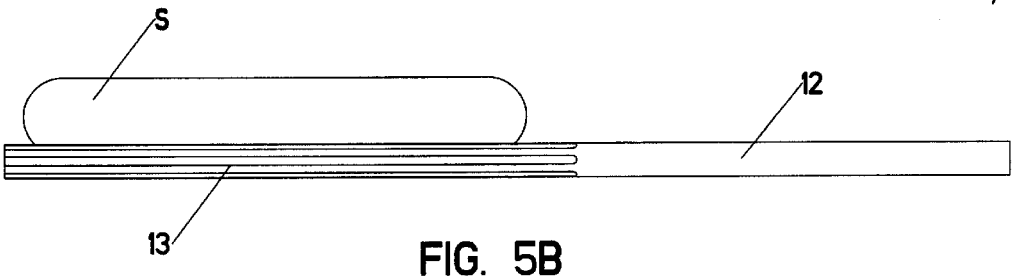
Figure 5C:
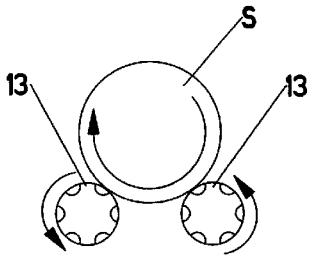

The device in accordance with the present invention is further provided with means for introducing a raw sausage into the chamber 3 and withdrawing the cooked sausage from the chamber. The introducing and withdrawing means include support means 11 for supporting a sausage. The support means includes preferably two rods 12 which are arranged substantially parallel to one another and are provided with engaging formations, for example projections 13 for the engagement of the sausage with the rods 12 during the operation. The rods 12 are rotatable in directions identified with arrows in FIG. 5A Because of the rotation of the rods 12, the sausage is continuously turned during the cooking process. The rotation on the rods is performed for example from a motor 14 which has an outlet shaft 15 connected by a belt transmission 16 with pulleys 17 arranged on the ends of the rods 12.

The introducing and withdrawing means further include means 18 for displacing the rods 12 in a longitudinal direction and reciprocating the rods when the sausage is located in the chamber 3. This means include a nut 19 located under platform 20, and connected with it, a screw 21 extending the nut 19, and a motor 22 which rotates the screw 21.

The housing 1 of the device is further provided with doors identified with reference numeral 23. The doors 23 can include an immovable door part 24, and a movable door part 25 which is movable between an open position and a closed position shown in FIG. 1. The movement of the upper door part 25 can be performed by known means, for example by a toothed rack 26 engaging with a totting gear 27 turnable by a drive. The door part 24 and 25 are provided with semicircular openings 28 which, in the closed position of the door, form circular opening for passing of the rods 11.

The device for treating sausages in a hot dog dispensing machine operates in the following manner:

A sausage S is placed on the rods 12, and the rods 12 are introduced into the chamber 3. The sausage S in the chamber 3 is subjected to the action of the microwave radiation from the microwave radiation means 4 and of the infrared radiation from the infrared radiation means 8. As a result, the interior of the sausage is thoroughly cooked by the microwave radiation, and the exterior of the sausage is thoroughly cooked by the infrared radiation to form a skin on the sausage. During the cooking process the sausage S is rotated due to the rotation of the rods 12 about their axes, and also is reciprocated in the longitudinal direction due to the reciprocation of the rods 12. When the sausage is finally cooked, the door 23 opens and the rods 12 are displaced in an opposite direction so as to withdraw the sausage S from the device.

It will be understood that each of the elements described above, or two or more together, may also find a useful application in other types of constructions differing from the types described above.

While the invention has been illustrated and described as embodied in a device forgetting sausages in a hot dog dispensing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A food cooking device, comprising:

a chamber for receiving food, the chamber including a door opening for receiving the food and at least one radiation opening for receiving radiation;

a moveable door for closing the door opening, the moveable door including at least one food holding device opening; and a food holding device for rotating the food and for transporting the food into and out of the chamber;

wherein the food holding device transports the food into the chamber;

wherein the radiation is received in the chamber via the at least one radiation opening; and wherein the food holding device rotates the food within the chamber while the radiation is received in the chamber, the food holding device fittably extending through the at least one food holding device opening while the food holding device rotates the food within the chamber.

2. The food cooking device of claim 1, wherein the food holding device is reciprocatably moveable while the food holding device rotates the food within the chamber.

3. The food cooking device of claim 2, wherein the door opening of the chamber for receiving the food is located at a first circular end of the chamber.

4. The food cooking device of claim 1, further comprising:

a fixed door portion.

5. The food cooking device of claim 1, further comprising:

a door moving mechanism.

6. The food cooking device of claim 5, wherein the movable door includes a rack portion, and wherein the door moving mechanism includes a toothed gear engageable with the rack portion.

7. The food cooking device of claim 1, wherein the chamber has a generally cylindrical shape.

8. The food cooking device of claim 1, wherein the radiation includes microwave radiation.

9. The food cooking device of claim 8, wherein the radiation includes infrared radiation.

10. The food cooking device of claim 9, wherein the at least one radiation opening includes a first radiation opening for receiving the microwave radiation and a second radiation opening for receiving the infrared radiation.

11. The food cooking device of claim 1, wherein the food holding device includes two parallel cylindrical extensions.

12. The food cooking device of claim 11, wherein each of the two parallel cylindrical extensions rotates, and wherein the food holding device rotates the food via rotation of the two parallel cylindrical extensions.

13. The food cooking device of claim 12, further comprising:

a driver for moving and rotating the two parallel cylindrical extensions.

14. The food cooking device of claim 13, wherein the driver includes a rotator motor for rotating the two parallel cylindrical extensions.

15. The food cooking device of claim 13, further comprising:

a coupling mechanism for coupling the rotator motor to the two parallel cylindrical extensions.

16. The food cooking device of claim 11, wherein each of the pair of parallel extensions has a frictional surface for engaging the food when the food is placed thereupon.

17. The food cooking device of claim 16, wherein the frictional surface of each of the pair of parallel extensions includes grooves.

18. The food cooking device of claim 1, wherein the movable door includes a curved recess for partially forming the at least one food holding device opening.

19. The food cooking device of claim 1, wherein the food is a hot dog.

20. The food cooking device of claim 1, wherein the food is a sausage.

21. A food cooking device, comprising:

a cylindrical chamber having an opening for receiving a food item, the chamber having a chamber axis and a reflective inner surface, wherein the chamber has at least one radiation opening for receiving radiation; and a food holding device for rotating and reciprocatingly moving the food and for transporting the food into and out of the chamber via the chamber opening, wherein the food holding device includes a pair of rotatable extensions, each of the rotatable extensions having an extension axis, wherein the food rests on the pair of rotatable extensions;

wherein the food holding device is positionable such that the food resting on the pair of rotatable extensions is centrally located within the chamber and the food is rotatably and reciprocatingly moveable via the food holding device within the chamber.

22. The food cooking device of claim 21, wherein, when the food holding device is positioned such that the pair of extensions are centrally located within the chamber, the extension axis of each of the pair of extensions is parallel to the chamber axis.

23. The food cooking device of claim 21, wherein the chamber axis is horizontal.

24. The food cooking device of claim 21, further comprising a door for selectively closing the chamber opening, wherein the door includes a pair of recesses for partially encircling the pair of extensions when the pair of extensions are positioned within the chamber.

25. A food cooking device, comprising:

a housing;

a cylindrical chamber having a reflective inner surface, a chamber opening for receiving food, and a radiation opening for receiving radiation;

a source of radiation communicating with the cylindrical chamber via the radiation opening;

a food delivery device comprising at least two cylindrical extensions for transporting the food placed thereupon, each of the at least two cylindrical extensions being rotatable so as to rotate the food during cooking of the food, wherein the food delivery device is reciprocatingly moveable; and a closable door for the chamber opening, the closable door including at least two recesses, each of the at least two recesses at least partially encircling one of the at least two cylindrical extensions when the closable door is in a closed position;

wherein the food delivery device locates the transported food within the chamber via the at least two recesses, wherein the food delivery device rotates the food when the food is located in the chamber; wherein the food delivery device reciprocatingly moves the food when the food is located within the chamber; and wherein the radiation from the radiation source cooks the food when the food is located within the chamber.

26. A method for cooking food, the method comprising:

receiving the food on a food holding device;

transporting the food holding device into a chamber for receiving food, the chamber including a chamber opening for receiving the food and the food holding device, wherein the chamber further includes at least one radiation opening for receiving radiation;

closing a door for the chamber opening, the door including at least one food holding device opening;

rotating and reciprocating the food within the chamber via the food holding device, the food holding device extending into the chamber via each of the at least one food holding device opening; and receiving radiation in the chamber via the at least one radiation opening, such that the food is cooked.

* * * * *